United States Patent [19]

Twito

[11] Patent Number: 5,014,610

[45] Date of Patent: May 14, 1991

[54] AIR OUTLETS IN AIR CONDITIONING UNITS

[76] Inventor: Israel Twito, 3 Rehov Shweidelson, Herzlia, Israel

[21] Appl. No.: 411,316

[22] Filed: Sep. 22, 1989

[51] Int. Cl.[5] ..... F24F 13/15

[52] U.S. Cl. ..... 98/110; 98/40.24; 98/107; 98/114

[58] Field of Search ..... 98/40.24, 40.27, 101, 98/103, 107, 110, 114

[56] References Cited

U.S. PATENT DOCUMENTS

| | | | |
|---|---|---|---|
| 518,984 | 5/1894 | Zimmerman | 98/107 X |
| 1,502,887 | 7/1924 | Swensen | 98/110 X |
| 2,479,773 | 8/1949 | Piehl | 98/110 |
| 2,907,262 | 10/1959 | Sweedyk et al. | 98/110 |
| 3,308,739 | 3/1967 | Gygax | 98/36 |

*Primary Examiner*—Harold Joyce

*Attorney, Agent, or Firm*—Edwin D. Schindler

[57] ABSTRACT

A modular outlet end units, or louvre units, for air ducts leading from a central air-conditioning plant, the louvre unit includes a plurality of sections which are include means for interconnection of a plurality of louvre units in order to enable the construction of any required size or dimension of outlet.

8 Claims, 3 Drawing Sheets

AIR OUTLETS IN AIR CONDITIONING UNITS

BACKGROUND OF THE INVENTION

This invention relates to louvres and, more particularly, to units destined to be positioned at the outlet ends of air ducts leading from central air conditioning plants. While the main use of these units is in connection with and for air conditioning arrangements, it would be within the scope of the invention to put them to different use, wherever louvres are conventionally employed.

The terms "unit" or "louvre unit" in the following description and the appended claims are intended to describe the assembly of components, i.e., the slats which are turnable about their major axes, the shafts co-extensive with these axes and the four-side frame in which the shafts are journalled, as well as additional minor parts and accessories generally used for turning the slats into a selected position.

The outlet ends of air ducts leading from central air conditioning plants installed to supply cooled air into a number of rooms in a building or to different locations within a hall are not of standard, always similar dimensions. For that reason, the louvre units at different outlets have to be of correspondingly different perimeters. It becomes necessary, therefore, to prepare a unit for every outlet or to have on hand louvre units of different dimension according to need, as dictated by the differently sized outlet ends of the respective air ducts.

SUMMARY OF THE INVENTION

It is therefore an object of the present invention to provide louvre units which can be made to fit practically all outlets or air ducts. It should be stated, also, that the air ducts leading from the air conditioning plant are generally of four-sided cross-section, two oppositely disposed side walls thereof (practically the vertical ones) being generally of standard height, which is generally the same in all systems, while the top and bottom walls of the ducts vary from one system to another. In other words, the air ducts, as seen at their outlet ends, are almost always of the same height, but of varying widths.

So as to have louvre units which can be made to fit almost every width of air duct outlet, according to the present invention, the unit is comprised of a multiple number of sections which include means for the interconnection of sections for common manipulation.

According to a further embodiment of the invention, the side faces of the sections are provided with means for securely interconnecting vicinal sections.

According to a preferred embodiment, these means include alternatingly raised and recessed portions on the faces, the lateral edges of the portions being undercut, the arrangement being that raised portions on one section are in register with recessed portions on the vincinal section, so that successive sections can be connected with one another by sliding the raised portions of one section into the recessed one of the vincinally next section.

Obviously, the interconnected louvre units should be of a design that permits the turning of the slats of all sections simultaneously into a selected position. To this end, according to the invention, the shafts operating the slats are co-directionally interconnected so as to form, for all practical purposes, one through-going shaft which extends through all sections.

In a preferred embodiment of the invention, each shaft within a section has one end face provided with a diagonally extending slit while the opposite end has a diagonal ridge fitting into the slit of the next following shaft of the row of sections.

According to yet another feature of the invention, the individual slats are turned from the "shut" position (where the minor axes of a slat are in the vertical) into two "open" positions by turning them about their major axes, either clockwise or counterclockwise.

Othere objects and features of the present invention will now be described with reference being made to the accompanying drawing figures. It should, however, be understood that the drawing figures are intended as being solely illustrative of the present invention and are not intended as defining the limits and scope thereof.

BRIEF DESCRIPTION OF THE DRAWING

In the drawing, wherein similar numerals refer to similar features throughout the several views.

DETAILED DESCRIPTION OF THE DRAWING FIGURES

Figure 1:
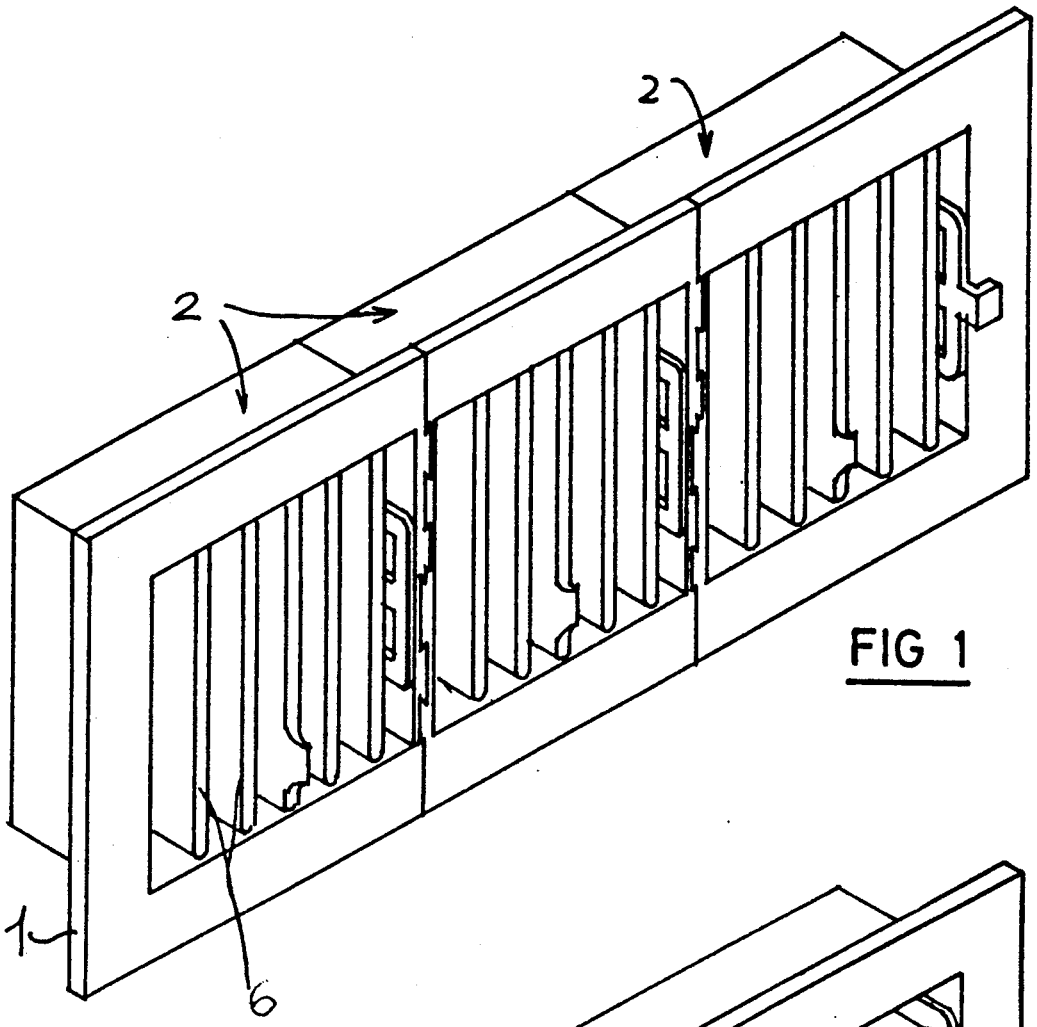
FIG. 1 is a perspective view of a louvre unit according to the invention.

Turning, first, to FIG. 1, which is assumed to show a louvre unit placed at the outlet end of an air duct leading from an air-conditioning plant, there is seen the frame 1, usually flush with the wall of the room into which the duct debouches. In the example shown, the unit is composed of three sections 2. Each of the sections 2 comprises a square casing, integral with frame 1, having a top wall 3, side walls 4 and bottom 5 (see, FIG. 2). In the square casing are journalled two sets of slats: vertical frontal slats 6, which turn about their major axes (FIG. 1), and horizontal slats 7, which are turnable also about their major axes (FIG. 2).

Figure 2:
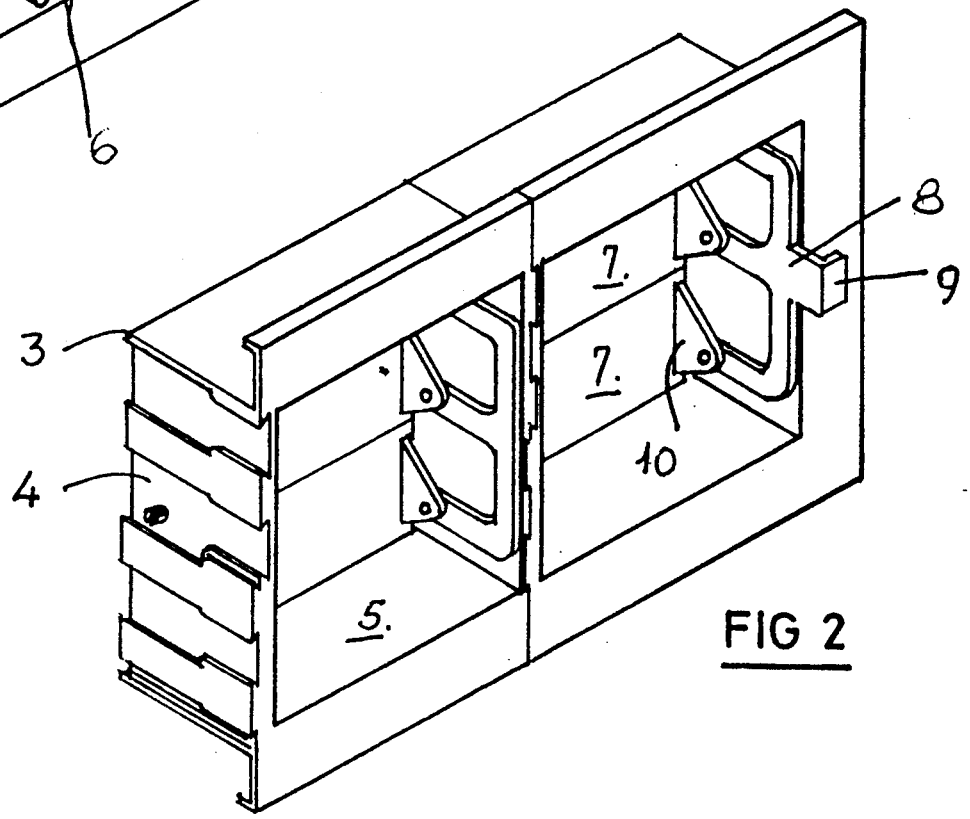
FIG. 2 is a fractional perspective view on a slightly larger scale of the unit, showing several internal details.

In FIG. 2, the vertical slats are removed.

Figure 3:
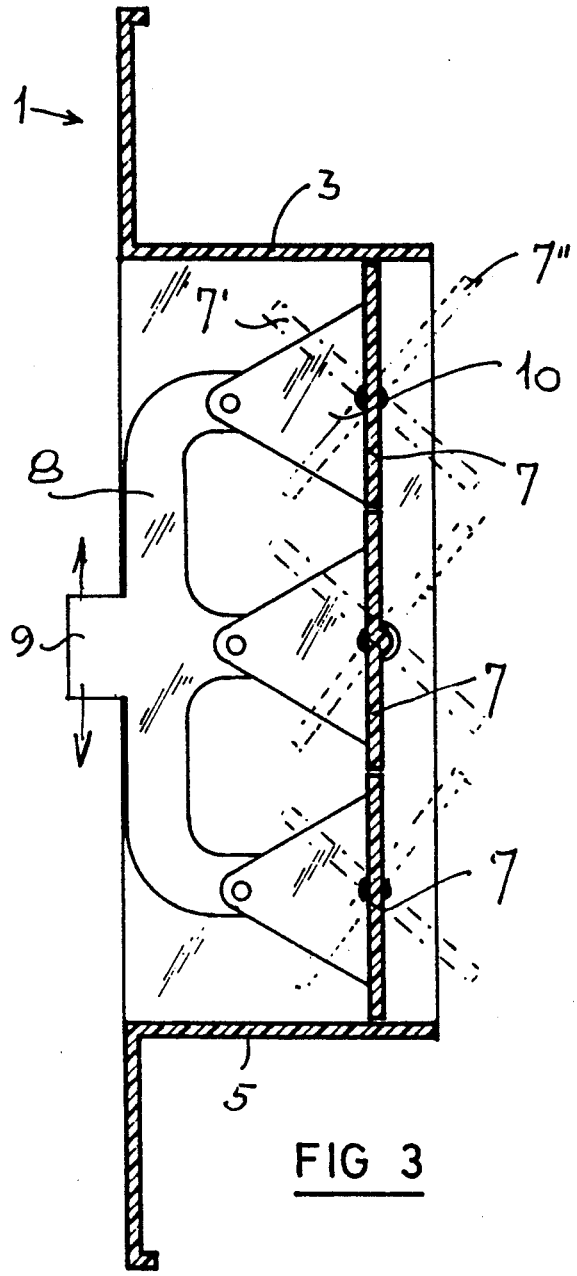
FIG. 3 is an elevational sectional view of such unit.
Figure 4:
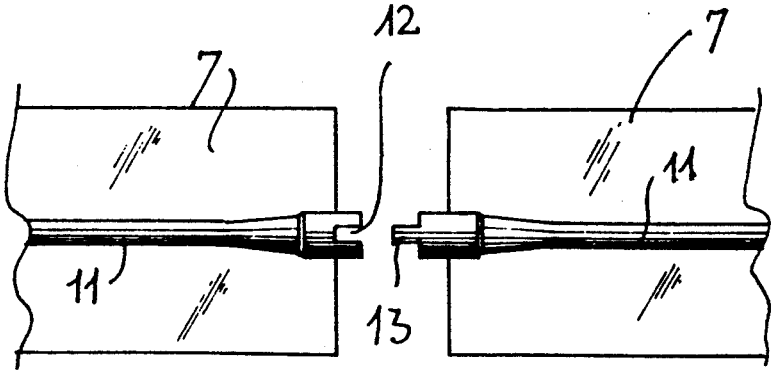
FIG. 4 illustrates the connection of the shaft passing from one section of the unit to another section.

The horizontal slats 7 in each section are interconnected by a trifurcated member 8, at least one of which has an outwardly extending small handle 9 by means of which the member 8 can be shifted upwardly or downwardly. This movement of member 8 causes the slats 7 which are linked to member 8 by ears 10, to follow and to assume from the shut position (shown in section in FIG. 3) either position 7′ or position 7″. So that all slats 7 of all sections should move equally and simultaneously, one of the slats in each section is made integral with a throughgoing shaft 11 (FIG. 4). All shafts at the same level in all sections are codirectionally interconnected by one end of a shaft in a section being provided with a diagonally extending slit 12 which can matingly receive a ridge 13 proviced at the end of a shaft 11 in the vicinal section. As a result, whenever the horizontal slats 7 in whatever section are manipulated by means of a handle 9, all slats in every section follow suit and perform the same movement.

The second set of slats 6 which extend vertically in the casings of the individual sections are journalled in top wall 3 and bottom 5 of each section. They are interconnected in a convdentional way by a bar (not shown) and can be moved, separately in each section, by small handles 14 extending from one of the slats 6.

Individual sections 2 can be connected with one another in a row by having the side walls 4 of each casing provided with raised portions 15 alternating with recessed ones 16. The edges of the recesses 16 are undercut. Recesses 16 in one section are one the level of raised portions in the vicinal section. Thus, raised portions of one section can be slid into recesses 16 of the vicinal section, so firmly connecting several sections to form a row, as represented by FIG. 1.

Figure 7:
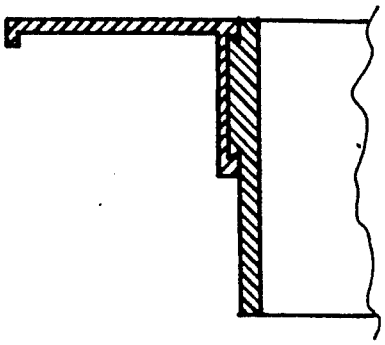

It should be noted that the sections which compose a couplet outlet grill have a frame-like extension at one or two opposing sides. In the event that a section which does not have a frame extension is used, a frame-like profile could be attached as seen in FIG. 7, for example, by means of a dove-tail connection.

Figure 6:
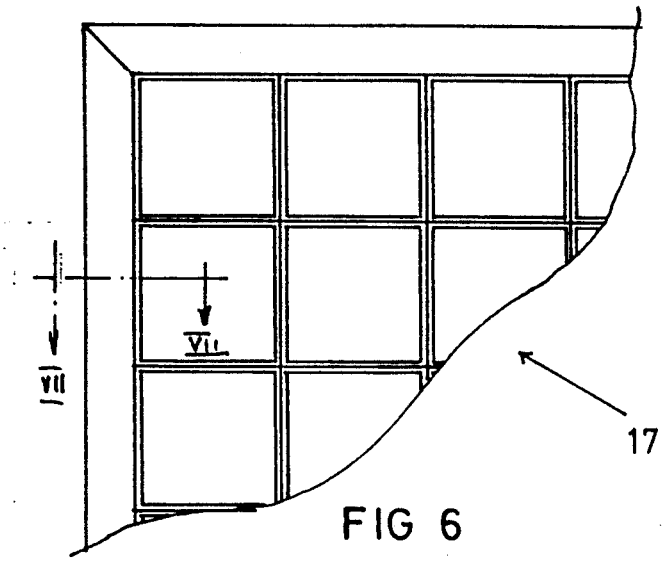
FIG. 6 is a fractional frontal view of a louvre unit in which sections of the type of FIG. 5 have been included; and, FIG. 7 is a sectional view taken along the VII—VII line of FIG. 6.

While, as has been stated above, mostly the height of the outlet end of an air duct leading from the air-conditioning plant is always the same, so that only the louvre unit's width has to be varied from case to case, sometimes the place where the air duct debouches into a room is rather restricted so that the louvre unit may comprise a small number sections (e.g., two sections only) as far as the width is concerned. For that contingency, section casings may be provided which have connecting means on all four sides so that instead of one long row of sections, two or more rows may be provided, as shown in FIG. 6.

Figure 5:
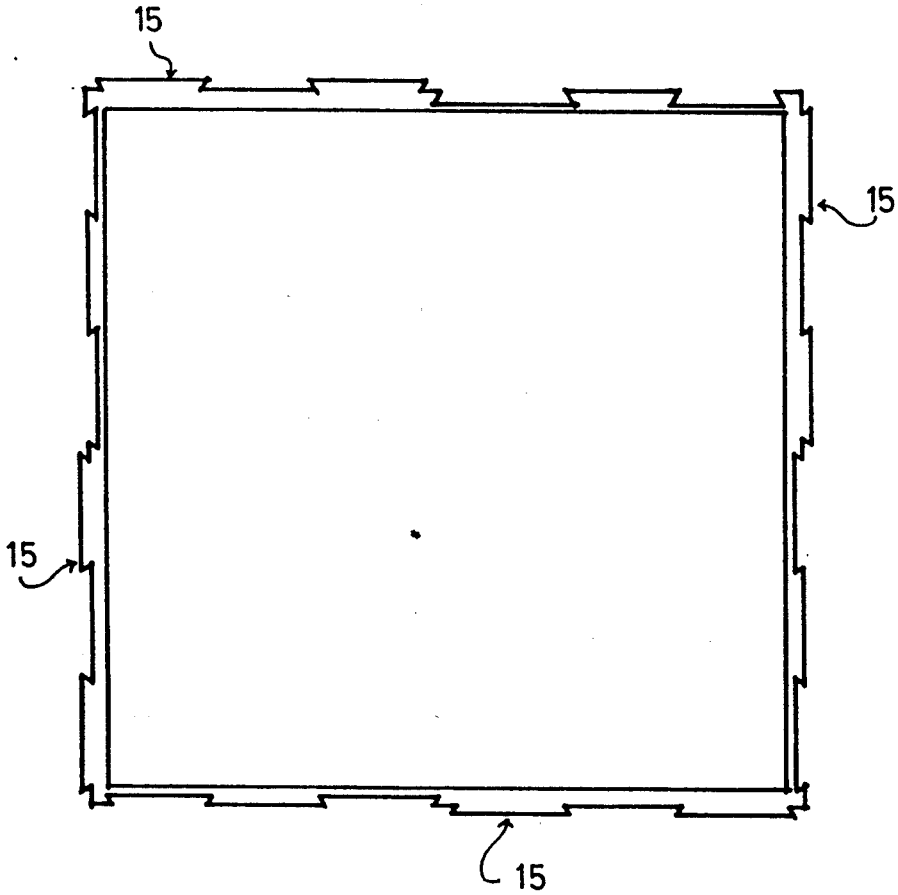
FIG. 5 is a schematical plan view of one section provided with a number of connecting means.

For that purpose, the four sides of a casing are provided with raised portions 15 alternating with undercut recessed portion 16 (FIG. 5). With such sections, a short row 17 of two or more section may be placed on top a similar row 18, as seen in FIG. 6. Such an arrangement can be accommodated in a narrow, confined place.

The sections which compose an air outlet are provided with extensions which when the sections are connected form a frame to the outlet. In those cases where a section is without such extension, a profiled frame, as discussed above, is connected to such section.

While only several embodiments of the present invention have been shown and described, it will be obvious to those of ordinary skill in the art that many modifications may be made to the present invention without departing from the spirit and scope thereof.

I claim:

1. A louvre unit, comprising:

a plurality of sections having means for interconnecting said sections for common manipulation, wherein each of said sections include side faces having means for securely interconnecting vicinal sections.

2. The louvre unit according to claim 1, wherein said means for interconnecting said sections includes alternatingly raised and recessed portions on said side faces, lateral edges of said recessed portions being undercut, with raised portions on one section being in register with the recessed portions on the vicinal section so that successive sections are capable of being connected to one another by sliding the raised portions of one section into the recessed portions of the vicinal next section.

3. The louvre unit according to claim 1, wherein said plurality of sections include a throughgoing shaft extending through all of said sections with the shafts having operating slats which are codirectionally interconnected.

4. The louvre unit according to claim 3, wherein each of the shafts within one of said sections has one end face which is provided with a diagonally extending slit, while an opposite end has a diagonal ridge fitting into the slit of an adjacent shaft of a row of said sections.

5. The louvre unit according to claim 3, further comprising means for rotating individual slats from a closed position, wherein minor axes of each slat are in a vertical position, to an open position, said means for rotating turning said slats in a clockwise direction.

6. The louvre unit according to claim 3, further comprising means for rotating individual slats from a closed position, wherein minor axes of each slat are in a vertical position to an open position, said means for rotating turning said slats in a counterclockwise direction.

7. The louvre unit according to claim 1, wherein each of said sections includes two sets of slats, the slats of one set extending in a horizontal direction and the slat of the other set extending in a vertical direction.

8. The louvre unit according to claim 1, wherein said means for interconnecting said sections are located at, at least, two sides of said louvre unit.

* * * * *